US007143666B1

(12) United States Patent
Gutierrez

(10) Patent No.: US 7,143,666 B1
(45) Date of Patent: Dec. 5, 2006

(54) FINGER RING BOTTLE OPENER

(75) Inventor: Tony M. Gutierrez, 407 McCormick, Bay City, MI (US) 48708

(73) Assignee: Tony M. Gutierrez, Los Vegas, NV (US)

( * ) Notice: Subject to any disclaimer, the term of this patent is extended or adjusted under 35 U.S.C. 154(b) by 0 days.

(21) Appl. No.: 10/821,381

(22) Filed: Apr. 9, 2004

(51) Int. Cl.
*B67B 7/16* (2006.01)

(52) U.S. Cl. ..... 81/3.55; 81/177.3; 81/3.09; D8/40

(58) Field of Classification Search ..... 81/3.55, 81/177.3, 3.57, 3.09; D8/18, 40
See application file for complete search history.

(56) References Cited

U.S. PATENT DOCUMENTS

| | | | | |
|---|---|---|---|---|
| 888,580 | A * | 5/1908 | Brinn | 81/3.41 |
| D41,178 | S | 2/1911 | Francis | |
| 2,548,517 | A | 4/1951 | Clark | |
| 3,495,284 | A | 2/1970 | Weingardt | |
| 4,667,544 | A | 5/1987 | Milo | |
| 4,825,728 | A | 5/1989 | Mitchell | |
| 4,869,134 | A | 9/1989 | Sprecher | |
| D303,915 | S | 10/1989 | Knutson | |
| 4,919,016 | A | 4/1990 | Hanegraaf | |
| D310,158 | S | 8/1990 | Chan | |
| 5,029,495 | A * | 7/1991 | Rosenberger | 81/3.09 |
| 5,133,233 | A | 7/1992 | Erwin | |
| D337,708 | S | 7/1993 | Morris, Jr. | |
| D347,152 | S | 5/1994 | Mohawk et al. | |
| D373,941 | S | 9/1996 | Davis | |

* cited by examiner

*Primary Examiner*—Debra S Meislin
(74) *Attorney, Agent, or Firm*—Reising, Ethington, Barnes, Kisselle & Learman, P.C.

(57) ABSTRACT

The finger ring bottle opener includes a continuous ring band with a finger passage and a finger passage axis. A bar integral with a band palm portion extends from the band distal end and is generally parallel to the finger passage axis. A bottom surface of the bar is a cap top engaging surface. A short shank is integral with the band palm portion and extends radially outward from the band. A prong is integral with the shank and extends forward from the shank. A bottle cap skirt bottom engaging surface is on the prong. When the skirt bottom engaging surface is in engagement with a cap skirt bottom and the bar is engaging the cap top, the cap top surface is substantially parallel to the finger passage axis.

5 Claims, 2 Drawing Sheets

FIG - 1
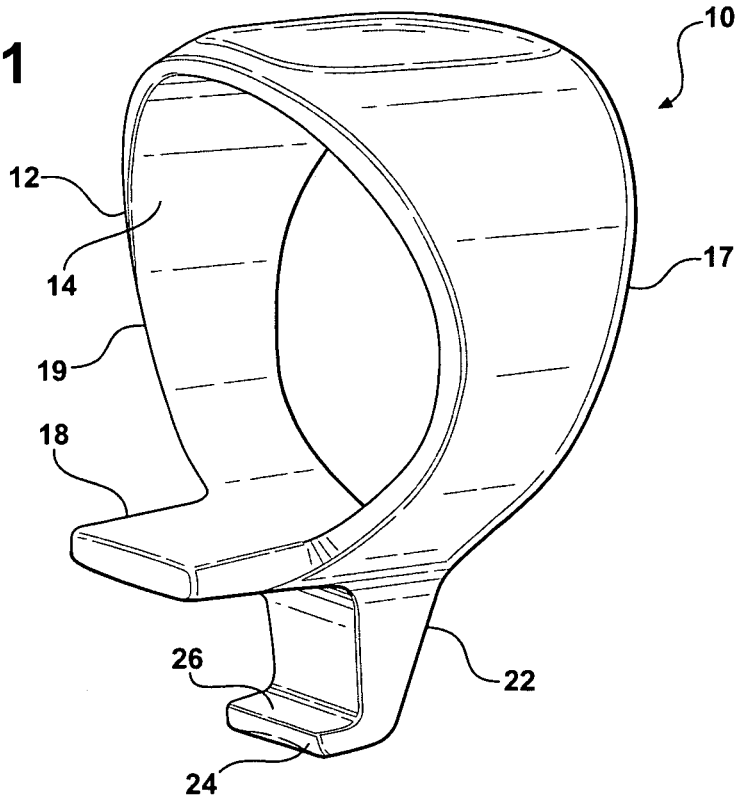
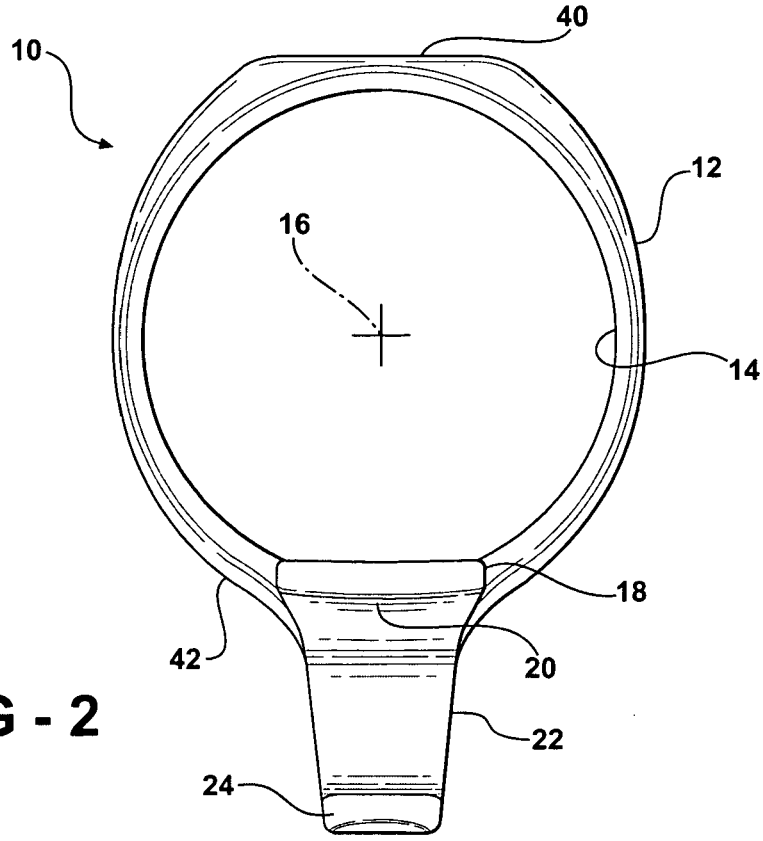
FIG - 2

FINGER RING BOTTLE OPENER

FIELD OF THE INVENTION

The present invention relates to rings, which, when worn on a finger, function as jewelry while at the same time being capable of use to remove a crown cap, or the like, from a bottle or other container.

BACKGROUND OF THE INVENTION

Cap removers with a variety of configurations are known for prying pressed on crown caps from bottles of carbonated beverages and other liquids. There are problems with such devices. One problem is that the user must search for the cap removers in order to use them to dislodge a cap. The search time is important in establishments such as restaurants, bars, hotels, hospitals, nursing homes and various other business establishments. If the customers are required to wait too long, they will take their business to a competitor with faster service.

Finger ring bottle openers are available to eliminate the need to search for a cap remover and shorten the time required to remove a bottle cap and serve the refreshment stored in the bottle. One finger ring bottle opener has a bar member that engages the cap top surface and a hook member that engages the bottom of the cap skirt. Both the bar member and the hook member extend radially outward at an angle less than 90° from the ring band. With this geometry, the center line through the ring finger passage approaches a position perpendicular to a plane including the top cap surface. This orientation makes it rather difficult to engage a crown cap when the container is upright. For most individuals the crown cap is easier to engage with the ring bottle opener if the container is tilted toward a horizontal position from the normal vertical position.

A radially extending cap top surface engaging member and a radially extending cap skirt engaging member create problems when using the hand to grasp other objects. They keep the palm side of a finger from engaging a flat surface and make it difficult to reach into pockets.

Finger ring openers with two spaced apart bars that engage the top of a crown cap have also been tried. With this particular bottle opener the palm side of a person's finger is in direct contact with a top surface of a cap. It has been found that a person's finger is occasionally pinched by such a bottle opener. A person's finger can also be injured if the top of the container breaks.

SUMMARY OF THE INVENTION

The finger ring bottle opener has a continuous ring band with a finger passage. The finger passage has an axis, a finger passage proximal end, and a finger passage distal end. A bar is integral with one side of the band and extends forwardly from the band generally parallel to the axis. The bottom surface of the bar is generally parallel to the axis. A short shank extends radially outward from the band and the bar. A prong is integral with a free end of the shank and extends forward from the shank. The prong has a cap skirt bottom edge engaging surface that is substantially parallel to the axis of the finger passage. During use the top surface of the prong engages the bottom edge of a cap skirt and urges it away from the bottle. The free end of the bar simultaneously engages the center portion of the top surface of the cap.

BRIEF DESCRIPTION OF DRAWINGS

These and other objects, features and advantages of this invention will become readily apparent in view of the following detailed description of the preferred embodiments and best mode, appended claims and accompanying drawings, in which:

FIG. 1 is an enlarge prospective view of the finger ring bottle opener;

FIG. 2 is a front elevational view of the ring;

DETAILED DESCRIPTION OF THE PREFERRED EMBODIMENTS

Figure 3:
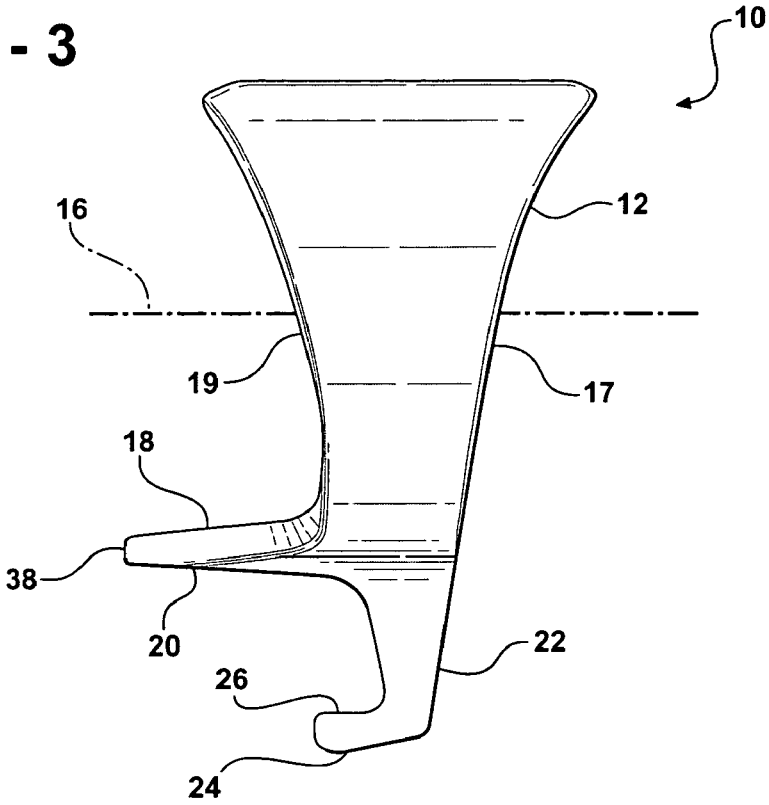
FIG. 3 is a side elevational view of the ring.
Figure 4:
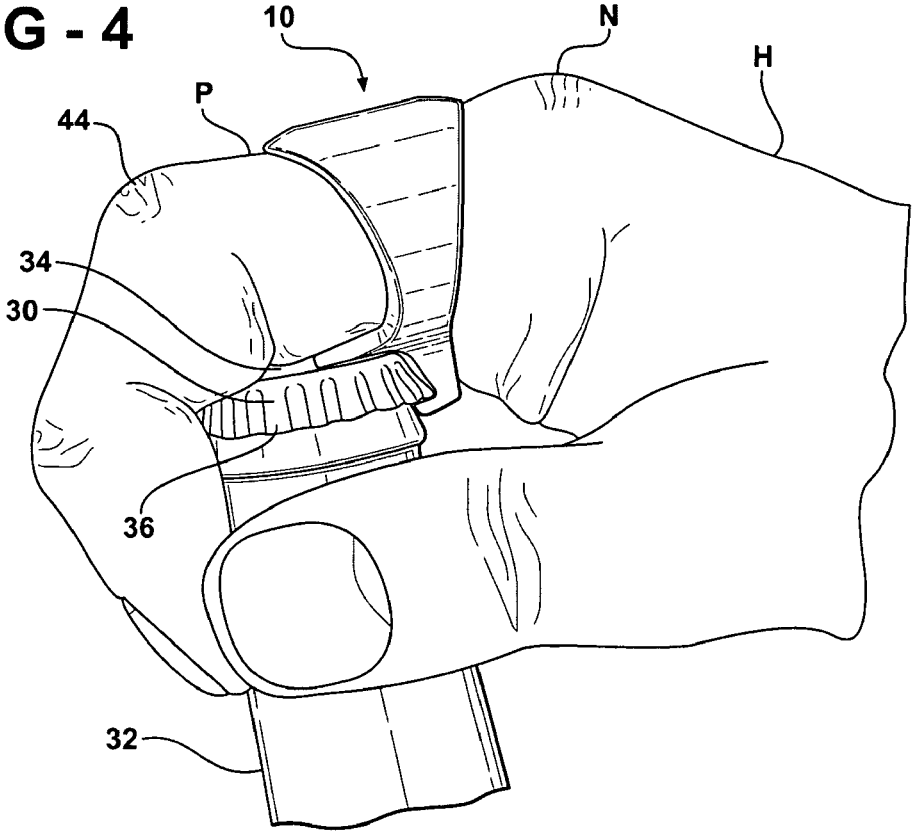
FIG. 4 is a reduced prospective view of the finger ring bottle opener removing a bottle cap.

The finger ring bottle opener 10 has a continuous ring band 12. The ring band 12 has a finger passage 14 that receives the first phalanx of a person's finger rather snuggly so that the band does not fall from the finger and the long axis of the first phalanx is generally coaxial with the axis 16 of the finger passage 14. The ring band 12 has a proximal end 17 and a distal end 19. The ring band 12 also has a band top portion 40 and a band palm portion 42.

A bar 18 is integral with the palm side of the band 12 and extends forward from the distal end 19 of the band and generally parallel to the axis 16 of the finger passage 14. The bottom surface 20 of the bar 18 is generally parallel to the axis 16 of the finger passage 14 and is a bottle cap top engaging surface. A short shank 22 extends radially outward from the band 12. A prong 24 is integral with a free end of the shank 22 and extends forward from the shank. The upper surface 26 of the prong 24 is a cap skirt bottom engaging surface and extends forward from the shank 22 and slightly away from the cap top engaging surface 20 of the bar 18. The distance between the bottom surface 20 and the top surface 26 of the prong 24 is slightly larger than the height of a bottle cap 30.

During use of the finger ring bottle opener 10, the user's fingers are extended and the hand H is moved substantially horizontal toward a bottle 32 and a bottle cap 30. The top surface 34 the bottle cap 30 engages the bottom surface 20 of the bar 18 and guides the cap into the space between the bottom surface 20 and the upper surface 26 of the prong 24. The bottom surface 20 and the upper surface 26 are substantially parallel to the axis 16. However, there is a slight funnel shape that guides the cap skirt 36 into engagement with a shank 22. The hand H is rotated up as, the finger and distal end of the first phalanx P is forced toward the cap 30. The lower edge of the skirt 36 is urged upward by the upper surface 26 and the free end 38 of the bar 18 urges the center portion of the top surface 34 of the bottle cap 30 downward. If sufficient force is applied, the cap 30 is bent slightly and the cap is removed from the bottle 32.

The bottle 32 remains substantially vertical during cap removal. The hand H remains somewhat horizontal and pivotal movement in the wrist is minimized.

The continuous ring 12 opposite the bar 18 and the short shank 22 extends a substantial distance parallel to the axis 16 of the finger passage 14. As shown in FIG. 3, the maximum distance between the proximal end 17 and the distal end 19 of the band 12 is about half the length of the first phalanx, thereby providing a substantial surface area to receive the force required to remove a bottle cap 30. The distance between the proximal end 17 and the distal end 19 adjacent to the shank 22 is less than half the maximum distance between the proximal and digital ends of the continuous ring band 12. This shape exposes substantial portions of the first phalanx for cooling and to reduce perspiration.

To remove a bottle cap 30 from a bottle 32, a hand H with the finger ring bottle opener 10 mounted on the first phalanx of an extended finger is moved toward the bottle cap. The axis 16 of the finger passage 14 through the continuous ring band 12 is substantially parallel to the bottle cap top surface 34 as the opener 10 approaches the bottle cap 30. The bottom surface 20 of the bar 18 contacts the bottle cap 30 and guides the cap skirt bottom engaging surface 26 into a position under the lower edge of the skirt 36. In this position with the bar 18 in engagement with and centered on the bottle cap top surface 34, the axis 16 of the finger passage 14 is substantially parallel to the bottle cap top surface 34. The wrist is then raised moving the hand H and knuckles N upward. Upward movement of the knuckles N pivots the first phalanx P, with the bottle opener 10, about its distal end 44. The distal end 44 remains substantially fixed relative to the bottle cap 30. The pivotal movement of the first phalanx, with the bottle opener 10, forces the cap skirt bottom engaging upper surface 26 on the prong 24 into contact with the bottom of the cap skirt 36, deforms the bottle cap 30, and lifts the cap from a bottle 32. Movement of joints of the hand H and fingers is minimized during the application of force to the bottle cap 30.

I claim:

1. A finger ring bottle opener comprising:

a continuous ring band with a finger passage, a finger passage axis, a band proximal end, a band distal end, a band palm portion, and a band top portion;

a bar integral with the band palm portion, extending from the band distal end generally parallel to the finger passage axis, and having a bottom surface that faces radially outward;

a short shank integral with the band palm portion and extending radially outward from the band palm portion;

a prong integral with a free end of the short shank, extending forward from the short shank, and having a cap skirt bottom engaging surface that is generally parallel to the finger passage axis; and wherein the bottom surface of the bar is a bottle cap top engagement surface that cooperates with the cap skirt bottom engaging surface to remove bottle caps, and the bottom surface of the bar diverges from the cap skirt bottom engaging surface from the short shank in a direction toward a bar free end.

2. A finger ring bottle opener, as set forth in claim 1, wherein the proximal end is a maximum distance from the distal end on the band top portion and the proximal end is a minimal distance from the distal end on the band palm portion.

3. A finger ring bottle opener, as set forth in claim 1, wherein the bar includes a bar free end and the bottom surface extends from the free end toward the continuous ring band and radially away from the finger passage axis.

4. A finger ring bottle opener, as set forth in claim 3, wherein the bottom surface of the bar is a cap guide surface that cooperates with the cap skirt bottom-engaging surface to position a bottle cap for removal from a container.

5. A finger ring bottle opener, as set forth in claim 1, wherein the minimum distance between the bottom surface of the bar and the cap skirt bottom engaging surface exceeds a height of a bottle cap that is to be removed.

* * * * *